US005583626A

United States Patent [19]

Nagaoka

[11] Patent Number: 5,583,626

[45] Date of Patent: Dec. 10, 1996

[54] ELECTROPHOTOGRAPHIC DEVICE AND CLEANING APPARATUS FOR USE THEREWITH

[75] Inventor: Tomoo Nagaoka, Tokyo, Japan

[73] Assignee: Canon Kabushiki Kaisha, Tokyo, Japan

[21] Appl. No.: 401,700

[22] Filed: Mar. 10, 1995

[30] Foreign Application Priority Data

Mar. 15, 1994 [JP] Japan ..... 6-043842
Mar. 2, 1995 [JP] Japan ..... 7-043005

[51] Int. Cl.[6] ..... G03G 21/00

[52] U.S. Cl. ..... 355/304; 15/256.52

[58] Field of Search ..... 355/30, 215, 304; 15/256.5, 256.51, 256.52

[56] References Cited

U.S. PATENT DOCUMENTS 4,262,190 4/1981 Tsuda et al. ..... 15/256.52 X
5,119,144 6/1992 Hada et al. ..... 15/256.5

FOREIGN PATENT DOCUMENTS 58-182678 10/1983 Japan .

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

A cleaning apparatus for use with an electrophotographic image forming apparatus, includes a rotatable brush for removing toner adhered to a member to be cleaned, a filter housing provided remote from the brush with respect to said member to be cleaned, discharge openings formed in a plurality of surfaces defining the filter housing, and a filter disposed within the filter housing in a confronting relation to the discharge openings.

14 Claims, 8 Drawing Sheets

ELECTROPHOTOGRAPHIC DEVICE AND CLEANING APPARATUS FOR USE THEREWITH

BACKGROUND OF THE INVENTION

1. Field of the Invention

The present invention relates to a cleaning apparatus for removing matters adhered to a member to be cleaned, and an electrophotographic image forming apparatus having such a cleaning apparatus. The member to be cleaned may be an electrophotographic photosensitive member, a transfer drum or a fixing roller, for example. Further, the electrophotographic image forming apparatus serves to form an image on a recording medium by using electrophotographic process and may be an electrophotographic copying machine, an electrophotographic printer, an electrophotographic facsimile machine or an electrophotographic word processor, for example.

2. Related Background Art

Now, a construction of a cleaning apparatus considered during the creation of the present invention will be explained with reference to FIGS. 10 and 11. Incidentally, FIG. 10 is a cross-sectional view of a cleaning apparatus, and FIG. 11 is a side view of the cleaning apparatus. However, the construction shown in FIGS. 10 and 11 is considered in the course of creation of the present invention and is not already known.

In the illustrated example, the cleaning apparatus 100 is disposed in the proximity of a transfer drum (member to be cleaned) 30 rotated in a clockwise direction (shown by the arrow) to remove and collect waste toner adhered to the surface of the transfer drum 30. The cleaning apparatus 100 has a rotary brush 2 disposed in parallel with a rotary shaft (not shown) of the transfer drum 30, i.e. along an axial direction (perpendicular to the plane of FIG. 10) of the transfer drum 30 as shown in FIGS. 10 and 11. The rotary brush 2 is rotatably supported by a brush case 3 which is in turn slidably supported by a slide plate 4.. That is to say, the rotary brush 2 is constituted by brush fibers 2*a* provided on a peripheral surface of a rotary shaft 5 rotatably supported by the brush case 3 at both ends.

As shown in FIG. 10, slots 4a extending in a left-and-right direction in FIG. 2 (direction that the brush case 3 is shifted toward and away from the transfer drum 30) are formed on a bottom surface of the slide plate 4. Slide posts protruding from a bottom surface of the brush case 3 are slidably fitted into the respective slots 4*a*. Thus, as mentioned above, the brush case 3 is supported by the slide plate 4 for relative shifting movement in the left-and-right direction in FIG. 10 with respect to the slide plate 4. The brush case 4 is biased toward the transfer drum 30 (left in FIG. 10 or 11) by two springs 11 (FIG. 11) disposed between the brush case 3 and the slide plate 4 on both sides of the brush case. Incidentally, one end of each spring 11 is connected to a spring attachment portion 3*a* formed on the brush case 3 and the other end of the spring is connected to a spring attachment portion 4*b* formed on the slide plate 4.

The slide plate 4 is slidably supported by a bottom plate 13 secured to a frame of an image forming apparatus via slide stop plates 12 provided on both sides of the slide plate. That is to say, as shown in FIG. 11, upper and lower slots 4*c* extending in the left-and-right direction in FIG. 2 (direction that the rotary brush 2 is shifted toward and away from the transfer drum 30) are formed in side walls of the slide plate 4, respectively, and slide shafts 14 extending horizontally an inwardly from the slide stop plate 12 are slidably fitted in the corresponding slots 4*c*.

Accordingly, as mentioned above, the slide plate 4 is slidable with respect to the bottom plate 13. As shown in FIG. 11, slide return springs 15 are provided between the slide plate 4 and the bottom plate 13 on both sides of the slide plate. The slide plate 4 is biased away from the transfer drum 30 (toward right in FIG. 11) by the return springs 15 until urging portions 4*d* of the slide plate abut against urging cams 16. In this condition, the brush 2 is separated from the transfer drum 30. Incidentally, each urging cam 16 comprises a disc-shaped eccentric cam a cam shaft 17 of which is driven by a drive means M.

On the other hand, as shown in FIG. 10, the brush case 3 is provided at its one end with an opening 3*p* facing the transfer drum 30, and the rotary brush 2 is disposed within the opening 3*p*. First and second scrapers 18 and 19 are formed on the brush case 3 above and below the rotary brush 2, respectively. The first scraper 18 has a scraper blade 18*a*, and the second scraper 19 has a scraper blade (suction guide) 19*a* and a blow preventing seal plate 19*b*.

Further, a filter housing 20 is removably mounted within a rear opening 3*q* of the brush case 3, and a toner scattering member 21 is disposed at an intermediate portion 3*r* of the brush case 3 (portion between the rotary brush 2 and the filter housing 20). The filter housing 20 has a filter 22 and an end filter 23 attached to a rear opening of the filter housing.

In a non-cleaning condition, the rotary brush 2 is not rotated and is separated from the transfer drum 30. In this condition, the transfer drum 30 is not cleaned.

The present invention relates to the improvement in the above-mentioned technique.

SUMMARY OF THE INVENTION

An object of the present invention is to provide a cleaning apparatus and an image forming apparatus, which can effectively clean a member to be cleaned.

Another object of the present invention is to provide a cleaning apparatus and an image forming apparatus, which can maintain cleaning efficiency.

A further object of the present invention is to provide a cleaning apparatus and an image forming apparatus, which can prevent the scattering of toner.

A still further object of the present invention is to provide a cleaning apparatus and an image forming apparatus, which can improve toner collecting ability and improve reliability and service life.

A further object of the present invention is to provide a cleaning apparatus and an image forming apparatus, which can facilitate assembling to reduce the assembling cost.

The other object of the present invention is to provide a cleaning apparatus and an image forming apparatus, wherein air discharge openings are formed in a plurality of surfaces of a filter housing.

DETAILED DESCRIPTION OF THE PREFERRED EMBODIMENTS

The present invention relates to an improvement in the above-mentioned technique. According to the present invention, it is possible to reduce discharge resistance, thereby preventing the toner once introduced into a brush case from flowing back and leaking from the brush case through the periphery of a brush. Further, the service life of a filter can be extended. In addition, according to the present invention, scattering of toner can be prevented, and reliability and endurance can be improved.

Figure 6:
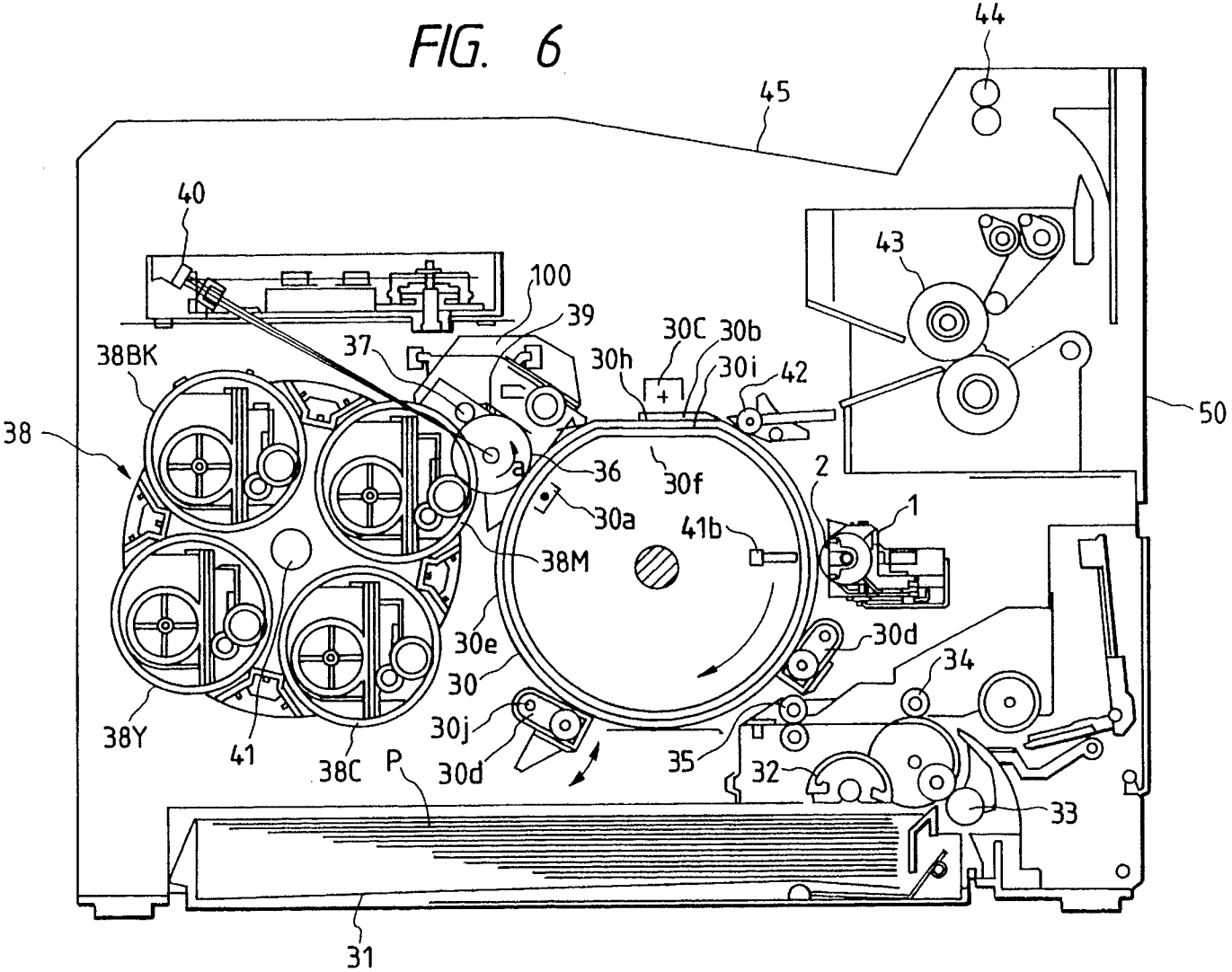
FIG. 6 is a schematic sectional view of a color image forming apparatus to which an embodiment of the present invention is applied.

FIG. 6 shows an electrophotographic full-color image forming apparatus (full-color laser beam printer). In such a color image forming apparatus, a recording material (recording sheet, OHP sheet and the like) P fed out by sheet supply rollers 32 and 33 from a sheet supply cassette 31 removably mounted to a frame 50 of the image forming apparatus is conveyed to a pair of register rollers 35 through a convey roller 34. Then, the recording sheet P is sent to a transfer drum 30 by means of the register rollers 35 in synchronous with a toner image for a first color formed on an electrophotographic photosensitive drum 36 and is absorbed to a peripheral surface of the transfer drum 30 for rotation together with it. Incidentally, in the illustrated embodiment, while the electrophotographic photosensitive drum was explained, in place of the drum, an electrophotographic photosensitive belt may be used.

The photosensitive drum 36 is rotated in a direction shown by the arrow a (FIG. 6) at a predetermined speed so that the surface of the drum 36 is uniformly charged by a charge means 37 such as a corona charger. A laser beam emitted from a scanner portion 40 in response to image information is illuminated onto the photosensitive drum 36, thereby forming a latent image corresponding to the image information on the photosensitive drum 36. The latent image for a first color is developed by magenta toner from a magenta developing device 38M of a developing means 38 to form a toner image. Then, the toner image (magenta color toner image) is transferred onto the recording sheet P held on the peripheral surface of the transfer drum 30 rotated at the peripheral speed the same as that of the photosensitive drum 36.

After the toner image was transferred to the recording sheet P, the residual toner remaining on the photosensitive drum 36 is removed by a cleaner (for example, an elastic cleaning blade) 39. At the same time, the developing means 38 including magenta, cyan, yellow and black developing devices 38M, 38C, 38Y and 38BK is rotated around a shaft 41 by 90 degrees, so that, in place of the magenta developing device 38M, the cyan developing device 38C is brought to a position opposed to the photosensitive drum 36. Incidentally, the magenta developing device 38M serves to develop the latent image by using magenta color toner. Similarly, the cyan developing device 38C, yellow developing device 38Y and black developing device 38BK serve to develop the latent image by using cyan color toner, yellow color toner, and black color toner, respectively.

In a similar manner to the above, regarding the cyan color, the charging, exposure, latent image formation and development are effected to form a cyan color toner image. Then, the cyan color toner image is transferred onto the same recording sheet P held on the peripheral surface of the toner drum 30 in a superimposed fashion. Similarly, a yellow color toner image and a black color toner image are successively transferred onto the same recording sheet P in a superimposed fashion. The recording sheet P to which the four color toner images were transferred is separated from the transfer drum 30 by a separation means 42, and the separated recording sheet is sent to a fixing device 43, where the toner images are fixed to the recording sheet P to form a full-color image. Thereafter, the recording sheet is discharged out of the apparatus. Incidentally, the residual toner remaining on the transfer drum 30 is removed and collected by a cleaning apparatus 1 according to the present invention. In FIG. 6, the reference numeral 44 denotes a pair of discharge rollers for discharging the recording sheet P; and 45 denotes a sheet receiving means provided on the frame and adapted to receive the discharged recording sheet P.

A transfer charger 30*a* serves to transfer the toner image formed on the photosensitive drum 36 onto the recording sheet P held on the peripheral surface of the transfer drum 30. Grippers 30*d* serve to grip a tip end of the recording sheet P in order to wind the recording sheet P around the peripheral surface of the transfer drum 30. The grippers 30*b* are pivotally mounted on corresponding shafts 30*j* for rotation in a direction shown by the arrow. Further, the grippers 30*b* are provided on flat portions 30*i* of the transfer drum 30 as will be described later. A separation charger 30*c* serves to facilitate the separation of the recording sheet P from the peripheral surface of the transfer drum 30. The reference numeral 30*d* denotes a small convey roller. A dielectric sheet 30*e* serves to electrostatically absorb the recording sheet P to wind the recording sheet around the peripheral surface of the transfer drum 30.

Figure 10:
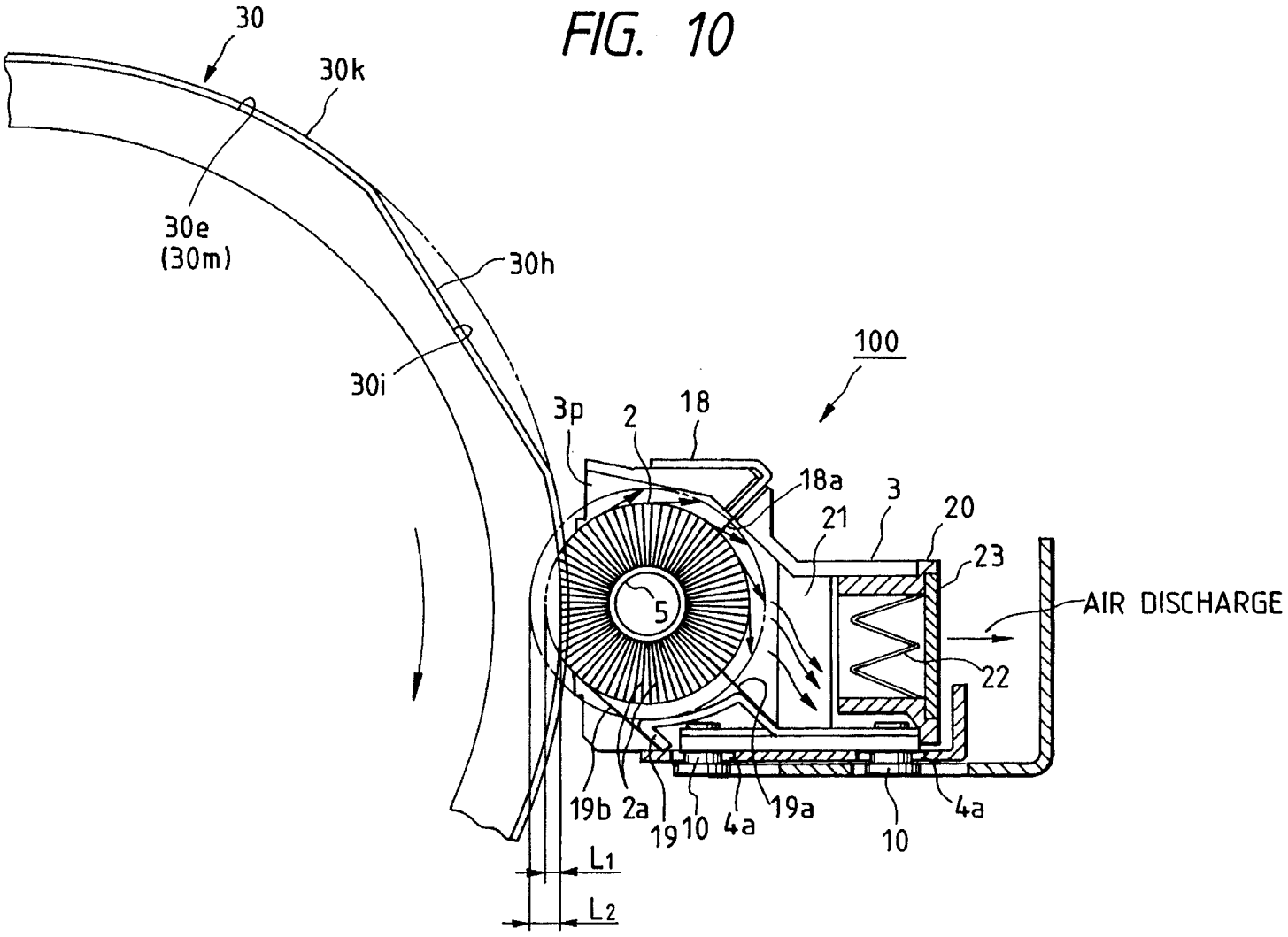
FIG. 10 is a cross-sectional view of a cleaning apparatus considered in the course of creation of the present invention.
Figure 11:
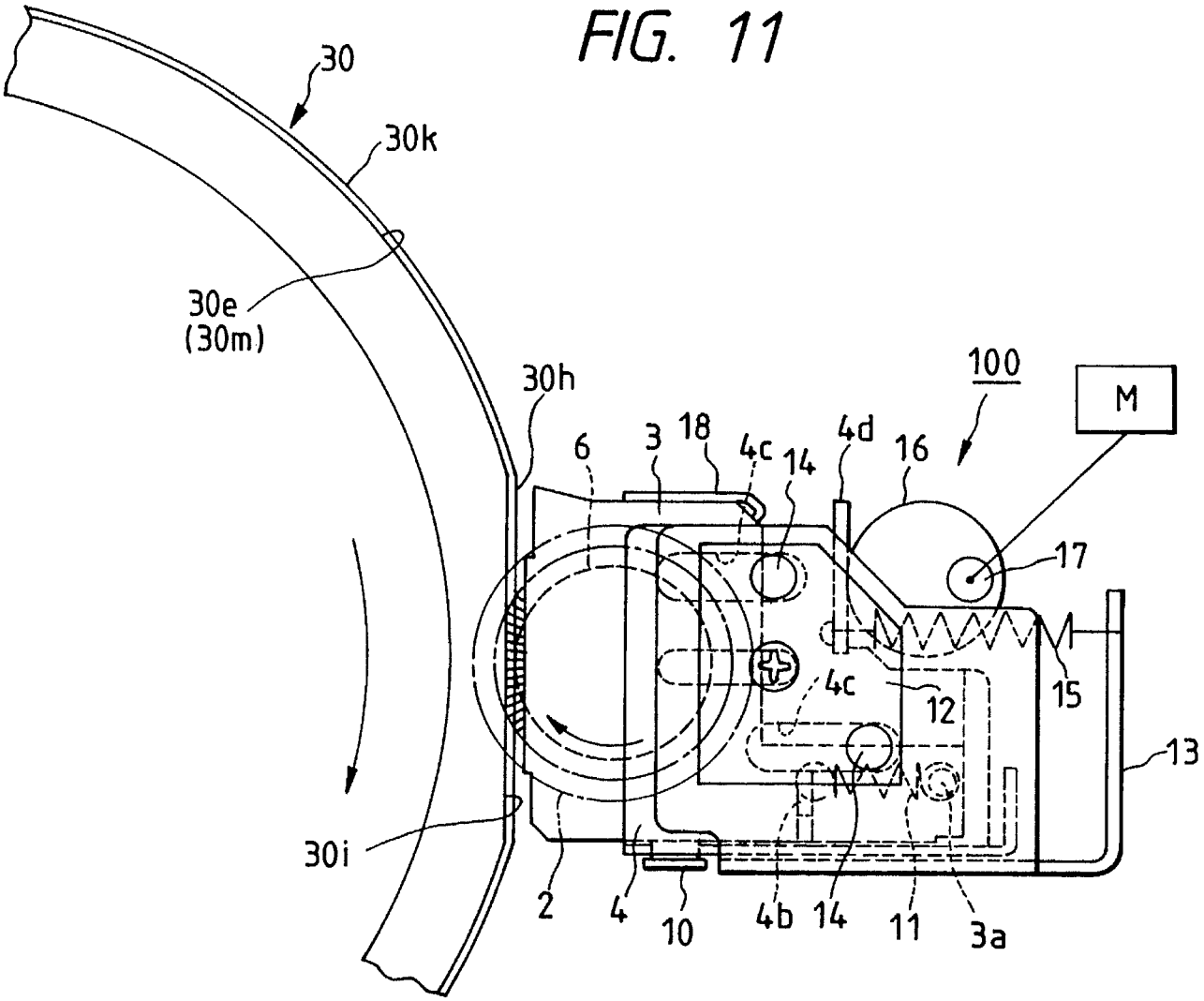
FIG. 11 is a side view of the cleaning apparatus of FIG. 10.

The fundamental construction of the cleaning apparatus according to the illustrated embodiment is the similar to the cleaning apparatus 100 shown in FIGS. 10 and 11. Accordingly, now, construction different from that in the cleaning apparatus 100 shown in FIGS. 10 and 11 will be explained, and the same constructural elements as those shown in FIGS. 10 and 11 are designated by the same reference numerals and explanation thereof will be omitted.

Figure 2:
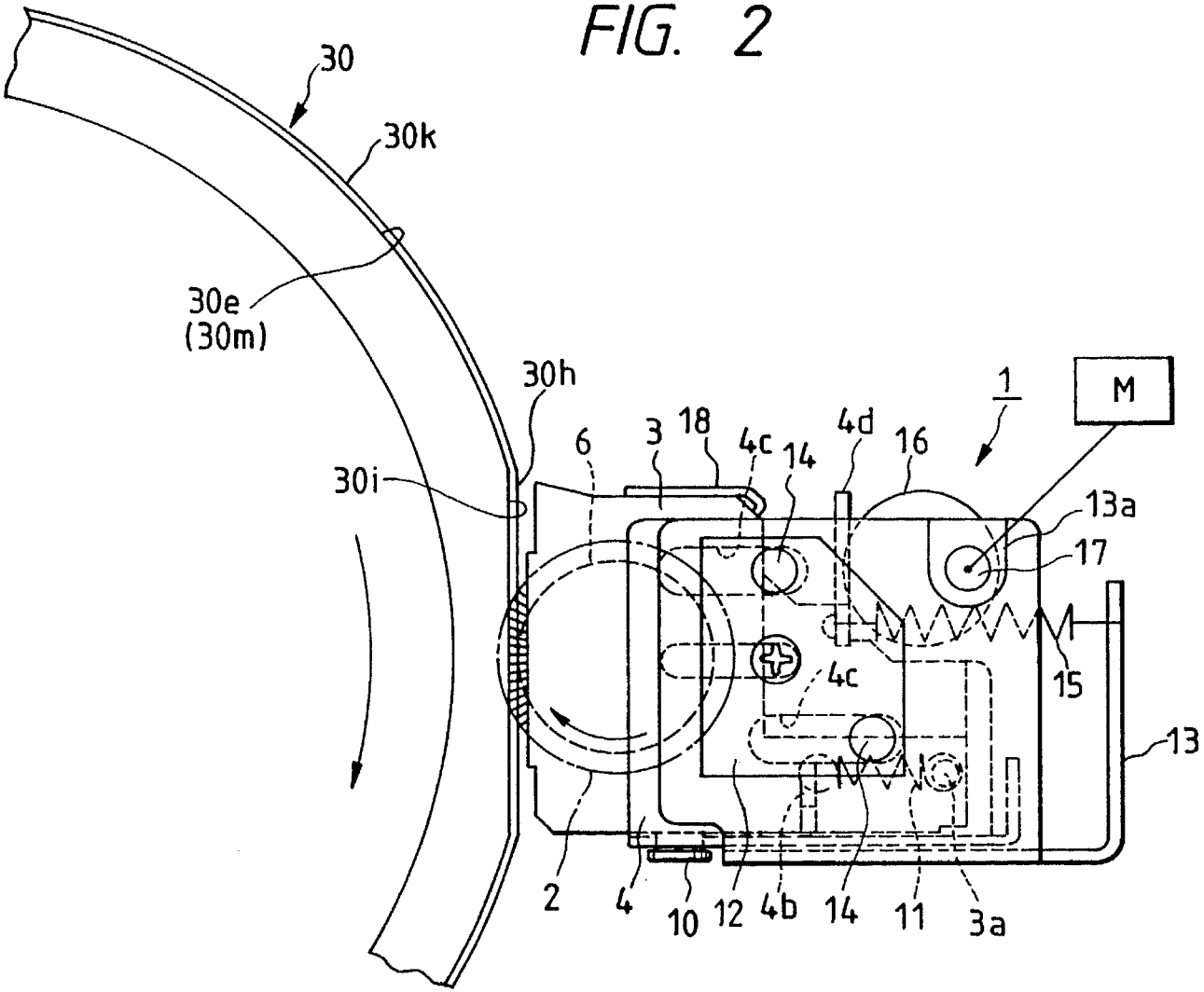
FIG. 2 is a side view of the cleaning apparatus of FIG. 1.
Figure 3:
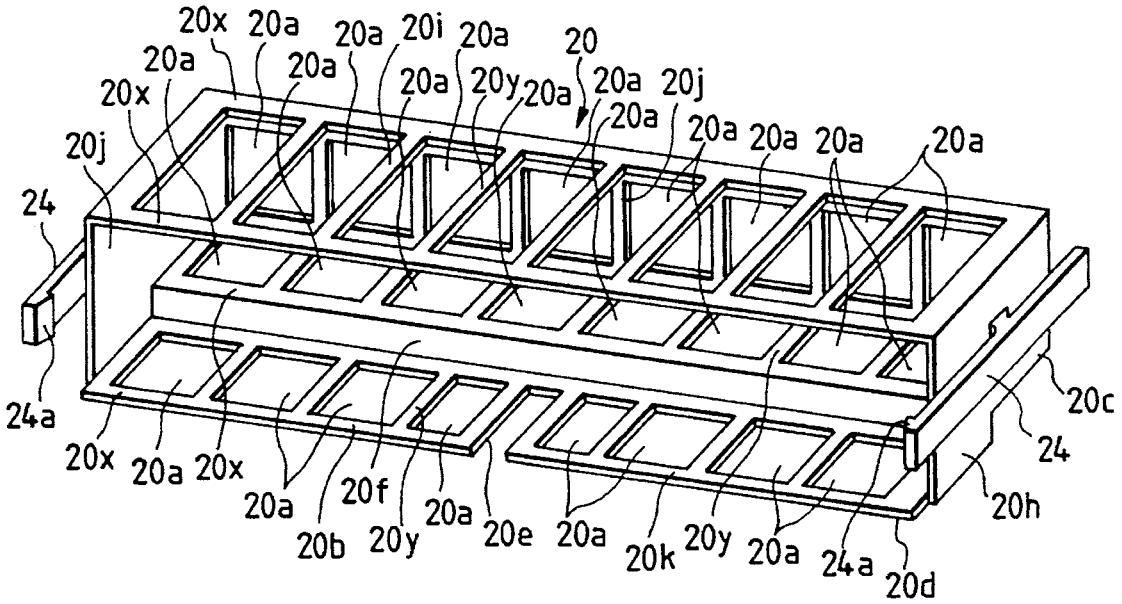
FIG. 3 is a perspective view of a filter housing.
Figure 4:
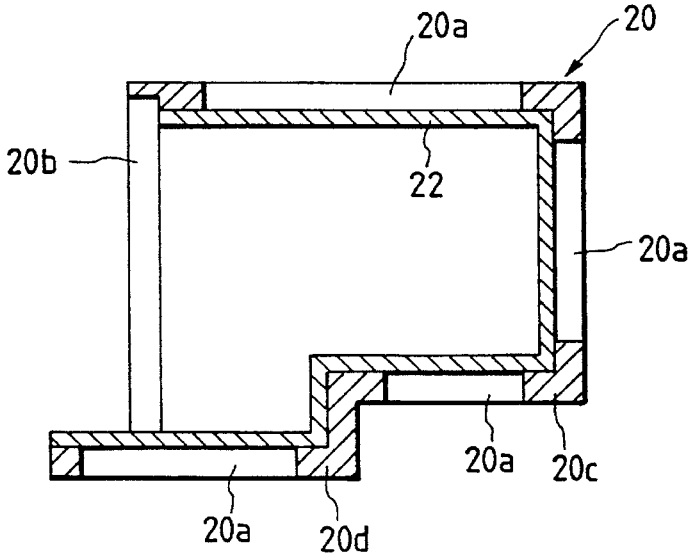
FIG. 4 is a cross-sectional view of the filter housing.
Figure 5:
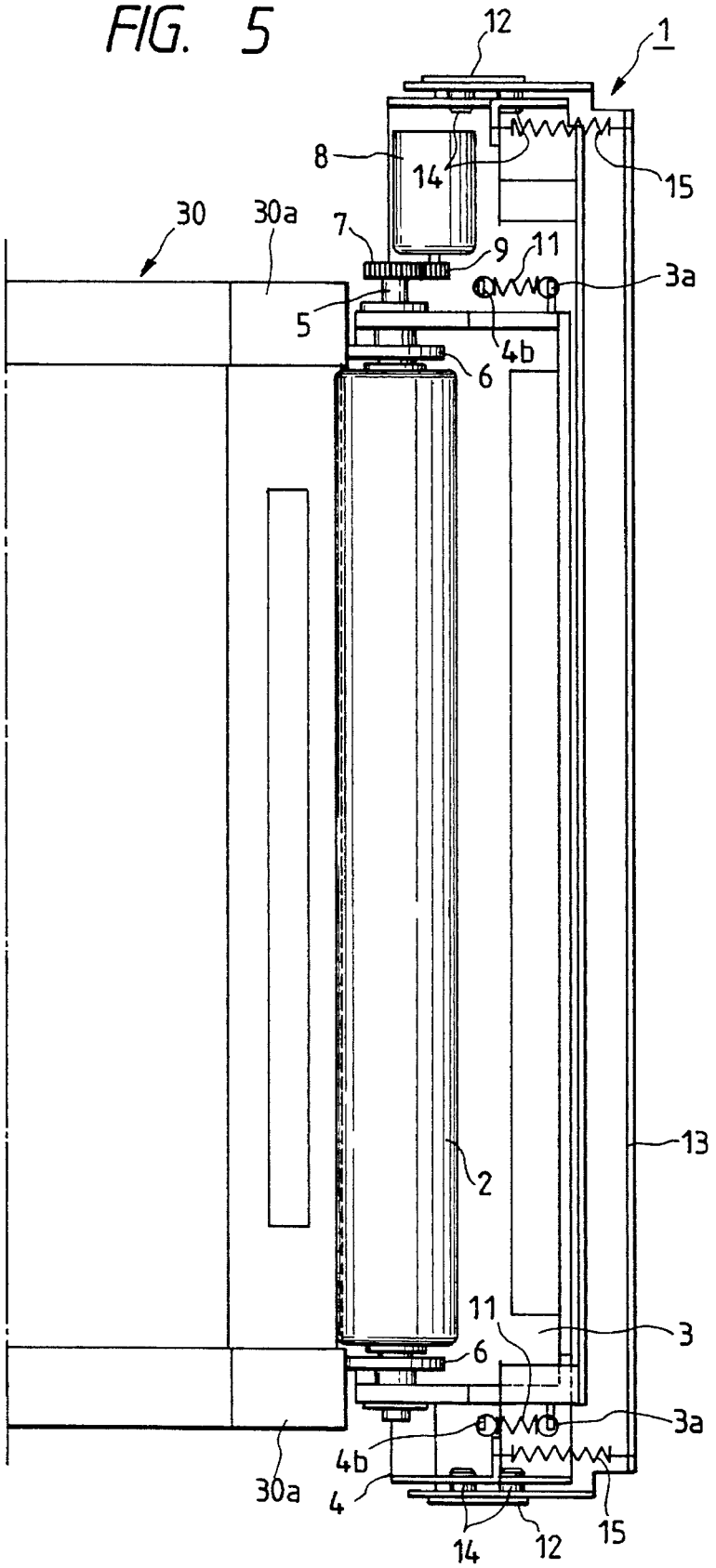
FIG. 5 is a plan view of the cleaning apparatus.

In an embodiment shown in FIGS. 1 to 5, as shown in FIG. 4, a filter housing 20 is integrally formed to have a laid U-shaped cross-section having an opening 20*f* at its one end (front end), and a bottom surface of the filter housing has stepped portions 20*c*, 20*d*.

As clearly shown in FIG. 3, the filter housing 20 has a plurality of air discharge openings 20*a* on the entire surface thereof except for the opening portion 20*f* (front surface) and both side surfaces 20*g*, 20*h* (i.e., the air discharge openings are formed in an upper surface 20*i*, a rear surface 20*j* and a bottom surface 20*k* of the housing). A recess 20*e* for attaching a filter to the housing 20 is formed in the stepped portion 20*d* of the bottom surface at a central portion thereof in a widthwise direction. That is to say, in a condition that the cleaning apparatus 1 is mounted to the frame 50 of the image forming apparatus, the plurality of air discharge openings 20*a* are formed on the upper surface 20*i* disposed upwardly, the bottom surface 20*k* disposed downwardly, and the rear surface 20*j* disposed remote from the transfer drum 30, respectively. When these openings 20*a* are formed in the surfaces 20*i*, 20*j*, 20*k*, by spacing these openings from each other, the strength of the housing 20 is maintained. The reason is that cross frames 20Y can be provided in connection with longitudinal housing frames 20X.

A cloth-shaped filter 22 is housed within the filter housing 20 in contact with the entire inner surfaces of the filter housing 20. Incidentally, the filter 22 may be divided into several pieces. Further, by engaging a portion of the filter 22 with the recess 20*e* of the housing 20, the filter 22 is removably attached to the housing 20.

Figure 1:
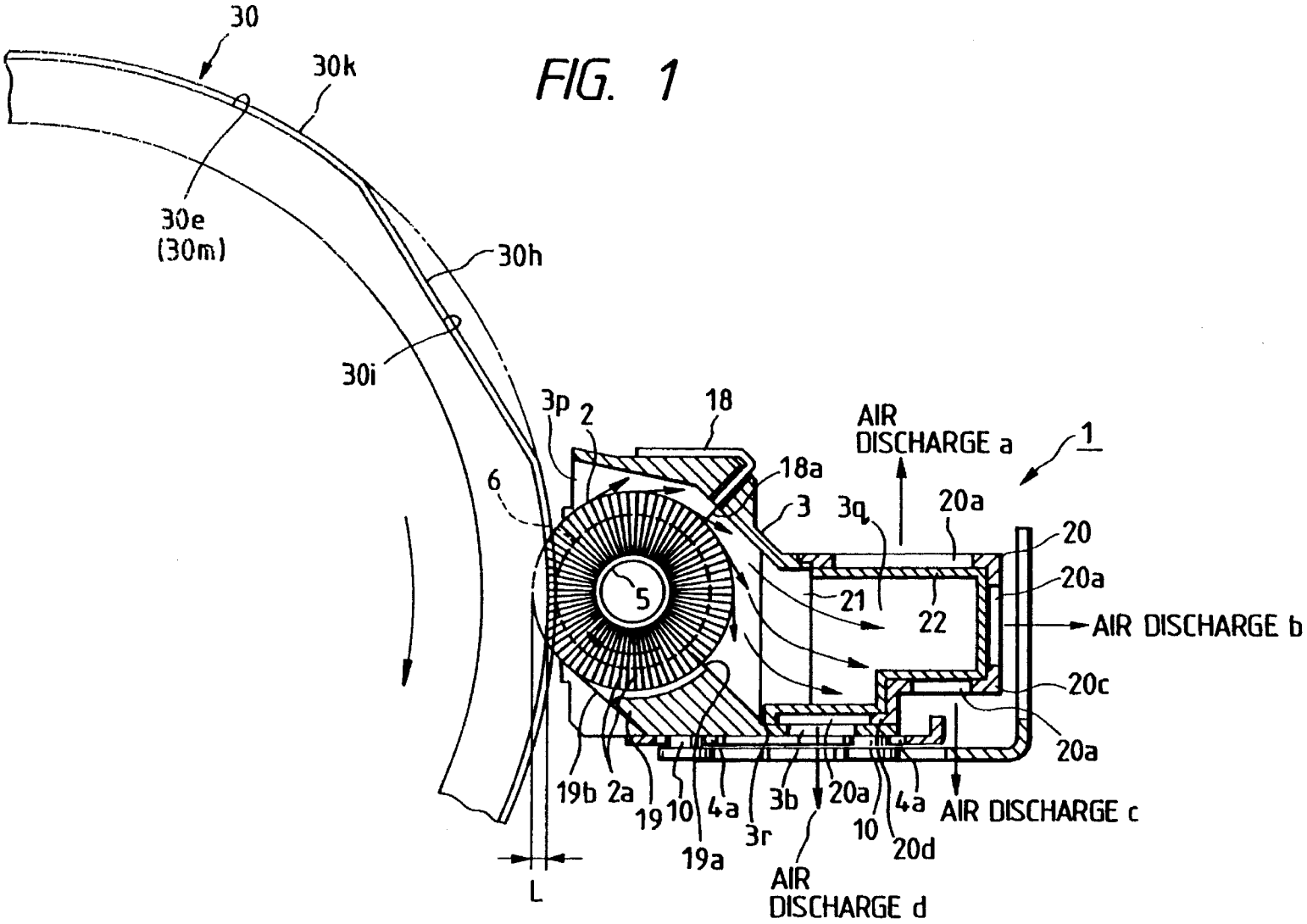
FIG. 1 is a cross-sectional view of a cleaning apparatus to which an embodiment of the present invention is applied.

A peripheral fitting portion 20*b* formed in a peripheral edge of the front opening 20*f* of the filter housing 20 into which the filter 22 is incorporated in this way is fitted on a rear end of the brush case 3. Further, by elastically engaging pawls 24*a* (FIG. 3) of hooks 24 secured to the side walls 20*g*, 20*h* of the housing with corresponding lock holes (not shown) formed in the brush case 3, as shown in FIG. 1, the housing 20 is removably mounted on the brush case 3. Further, as shown in FIG. 1, discharge openings 3*b* are formed in the bottom surface 3*r* of the brush case 3 so that, when the lower stepped portion 20*d* of the filter housing 20 is fitted on the brush case 3, these discharge openings 3*b* are aligned with the air discharge openings 20*b* formed in the stepped portion 20*d*.

Incidentally, in the illustrated embodiment, the cam shaft of the urging cams 16 is rotatably supported by bearings 13*a* provided on the side walls of the bottom plate 13.

Also in the cleaning apparatus 1 according to the illustrated embodiment, in a non-cleaning condition, the rotary brush 2 is not rotated and is separate from the transfer drum 30. In this condition, the transfer drum 30 is not cleaned.

In the cleaning of the transfer drum 30, when the operator depresses an operation button (not shown), a motor 8 is driven, and the rotation of the motor is subjected to the speed reduction through gears 9, 7 and is transmitted to the rotary shaft 5 of the rotary brush 2. As a result, the rotary brush 2 is rotated in the direction shown by the arrow in FIG. 1 (the same direction as the rotational direction of the transfer drum 30), and the urging cams 16 are rotated by the motor M by 180 degrees. Incidentally, cleaning of the transfer drum 30 by means of the rotary brush 2 may be performed automatically by driving the motor 8 and the motor M during the pre-rotation of the transfer drum 30 effected prior to the image formation, and, every after the sheet jam treatment is finished. When the urging cams 16 are rotated by 180 degrees, the slide plate 4 urged by the urging cams 16 via the urging portions 4*d* is shifted toward the transfer drum 30 in opposition to the biasing forces of the return springs 15. As a result, the brush case 3 supported by the slide plate 4 is also shifted to the same direction together with the rotary brush 2, with the result that, as shown in FIG. 1, guide rollers 6 of the rotary brush 2 abut against roller guide surfaces 30*k* of the transfer drum 30, thereby rotating the guide rollers. Consequently, the rotary brush 2 is rotated in a condition that the brush fibers 2*a* are penetrated into the transfer drum by a penetrated amount of L as shown, thereby scraping the waster toner adhered to a surface 30*m* (to be cleaned) of the transfer drum 30.

The scraped toner is conveyed toward the interior of the brush case 3 by pressure (shown by the arrows) generated by the rotation of the rotary brush 2 or while being adhered to the brush fibers 2*a*. In this case, the toner adhered to the brush fibers 2*a* is separated from the brush fibers 2*a* by a scraper blade 18*a* of a first scraper 18. The separated toner is conveyed into the brush case 3 together with the toner separated from the transfer drum 30 by the aforementioned pressure, under the action of an air flow (shown by the arrows) induced within the brush case 3 by the rotation of the rotary brush 2. The toner is caught by the filter 22 and is stored in the brush case 3, and only air passes through the filter 22 and is discharged out of the brush case 3 through the air discharge openings 20*a*.

Incidentally, also in the embodiment shown in Fig. 1, is the condition where guide rollers 6 abuts against the flat guide surface portion 30*c* of the transfer drum 30 as shown in FIG. 10. The rotary brush 2 and the brush case 3 are further shifted toward the transfer drum 30 under the action of the springs 11 by an amount ($L_2$ $L_1$) shown in FIG. 10, with the result that, as is in the above-mentioned case, the waste toner adhered to a flat surface portion 30*i* (to be cleaned) of the transfer drum 30 is removed by the rotary brush 2.

In the illustrated embodiment, as mentioned above, the plurality of air discharge openings 20*a* are formed in the entire surfaces (upper surface 20*i*, rear surface 20*j* and bottom surface 20*k*) of the filter housing 20. Thus, the air entering the brush case 3 is discharged upwardly, downwardly and rearwardly as shown by the arrows a, b, c and d in FIG. 1, thereby reducing the discharge resistance. That is to say, the air entered into the brush case 3 is discharged independently through the air discharge openings 20*a* formed in the upper surface 20*i*, rear surface 203 and bottom surface 20*k*. Thus, the toner sucked into the brush case 3 is conveyed within the brush case 3 along the arrows of FIG. 1 and is surely caught by the filter 22. Unlike to the conventional cases, there is no risk that the toner once sucked into the brush case 3 flows back to leak out of the brush case 3 through the periphery of the rotary brush 2. Thus, the conventional problem that the interior of the apparatus is polluted by the leaking toner can be eliminated, thereby providing good image quality. Particularly, in the illustrated embodiment, since the discharge ports 3*b* are formed in the bottom surface of the brush case 3, the air can be discharged downwardly through the discharge ports 3*b* (direction shown by the arrow d).

Incidentally, by appropriately selecting sizes of the air discharge openings 20*a* formed in the filter housing 20 and shield areas of the air discharge openings 20*a* shielded by the slide plate 4, it is possible to increase the discharge resistance at the toner suction opening 20*f* (front side) of the brush case 3 and to decrease the discharge resistance at the rear side of the brush case, thereby uniformly conveying the sucked toner through the whole interior of the brush case. Further, in the illustrated embodiment, since the filter 22 is mounted within the filter housing 20 in contact with the entire inner surface of the housing, the toner collecting ability of the toner cleaning apparatus 1 is enhanced, thereby realizing maintenance-free performance, improving the reliability and service life.

Incidentally, as shown in FIG. 2, in the condition that the guide rollers 6 abut against the flat roller guide surface 30*h* of the transfer drum 30, the rotary brush 2 and the brush case 3 are further shifted toward the transfer drum 30 by the biasing forces of the spring 11, with the result that waste toner adhered to the flat surface portion 30*i* (to be cleaned) of the transfer drum 30 is removed by the rotary brush 2.

Next, another embodiment of a filter housing 20 will be explained with reference to FIGS. 7 to 9. Incidentally, FIG.

Figure 7:
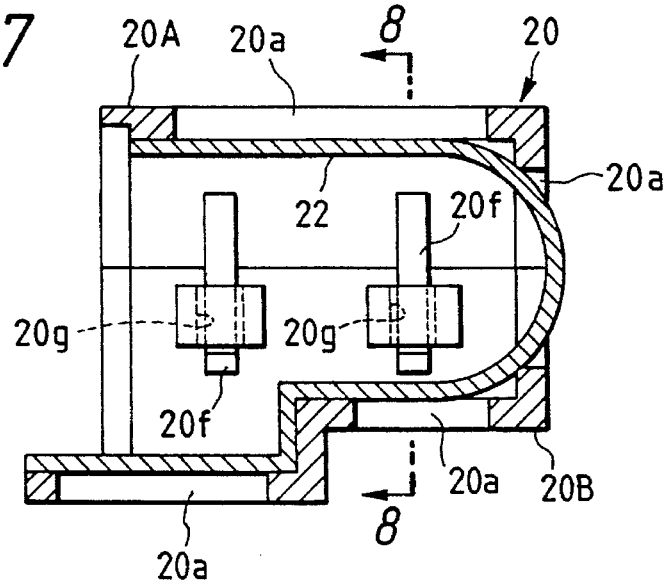
FIG. 7 is a cross-sectional view of an assembled filter housing according to another embodiment.
Figure 8:
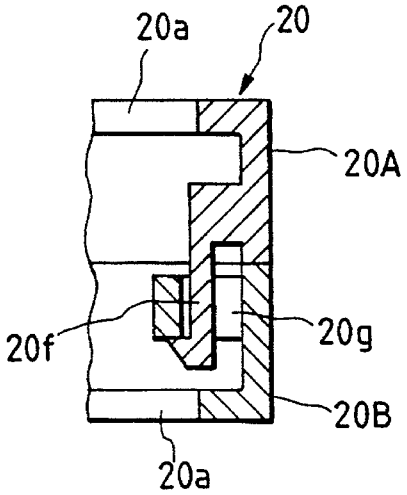
FIG. 8 is a sectional view taken along the line 8—8 in FIG. 7.
Figure 9:
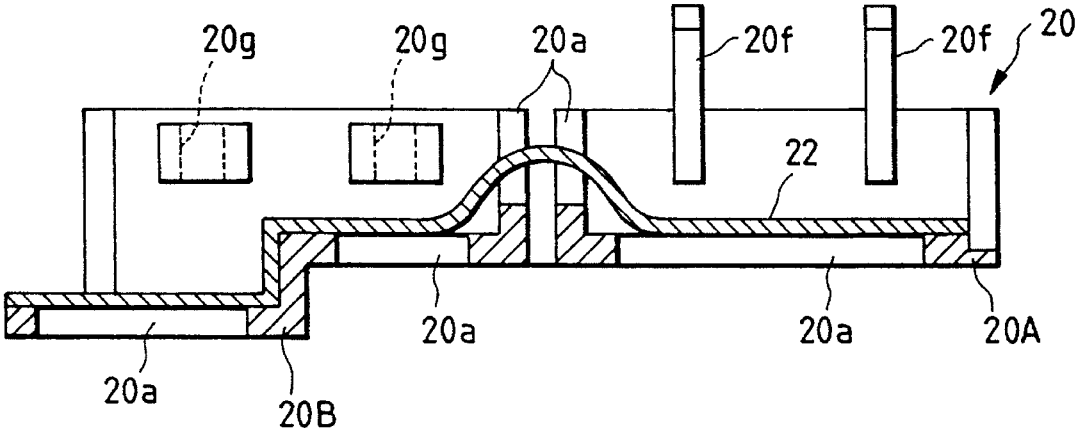
FIG. 9 is a cross-sectional view of a disassembled filter housing according to a further embodiment.

7 is a cross sectional view of a filter housing according to this embodiment in an assembled condition, FIG. 8 is a sectional view taken along the line 8—8 in FIG. 7, and FIG. 9 is a cross-sectional view of the filter housing in a pre-assembled or disassembled condition.

The filter housing 20 according to this embodiment is divided into an upper portion 20A and a lower portion 20B which can be assembled to and disassembled from each other. Locking hooks 20f are formed on the upper portion 20A and locking holes 20*g* are formed in the lower portion 20B. Incidentally, also in the filter housing 20 according to this embodiment, a plurality of air discharge openings 20*a* similar to those in the above-mentioned embodiment are formed in the entire surface of the filter housing 20.

In a condition that the upper portion 20A and the lower portion 20B are opened to each other as shown in FIG. 9, the filter 22 is secured within the filter housing by adhesive. Thereafter, the upper portion 20A and the lower portion 20B are closed with respect to each other, and, as shown in FIG. 8, the locking hooks 20*f* of the upper portion 20A are fitted into the corresponding locking holes 20*g* of the lower portion 20B, thereby assembling the filter housing 20 as shown in FIG. 7. Then, the filter housing 20 is attached to the brush case 3 as shown in FIG. 1 to prepare for the cleaning of the transfer drum 30. Also in this embodiment, the filter 22 is mounted within the filter housing 20 in contact with the entire inner surface of the later. The filter 22 may be divided into several pieces.

As mentioned above, according to this embodiment, since the filter housing 20 is divided into two portions, the assembling operation of the filter housing can be facilitated and the number of assembling steps is reduced, thereby making the cleaning apparatus inexpensive.

While the example of the member to be cleaned was a transfer drum, the present invention is not limited to such an example, but may be applied to any cleaning apparatuses and associated image forming apparatuses having a member to be cleaned other than the transfer drum.

As apparent from the above explanation, according to the above-mentioned embodiments, since the discharge resistance can be minimized, the leakage of toner can be prevented, thereby preventing contamination of the interior of the apparatus. Further, the toner collecting ability of the cleaning apparatus can be enhanced, thereby improving the reliability and service life of the apparatus. In addition, by providing discharge ports in the brush case in alignment with the air discharge openings of the filter housing, and since the air is also discharged through the discharge ports, the discharge resistance can be reduced to enhance the ability for preventing the toner from leaking from the brush case.

Further, by dividing the filter housing into a plurality of portions, the assembling operation including the mounting operation for mounting the filter within the filter housing can be facilitated, with the result that the number of assembling steps can be reduced, thereby making the cleaning apparatus cheaper. Lastly, there can be provided an image forming apparatus wherein the leakage of toner can be prevented to prevent contamination of the interior of the apparatus and the toner collecting ability of the apparatus can be enhanced to improve the reliability and service life of the apparatus.

As mentioned above, according to the present invention, the cleaning ability and reliability can be improved.

What is claimed is:

1. A cleaning apparatus for use with an electrophotographic image forming apparatus, comprising:

a filter housing having a brush opening formed in one surface thereof and being disposed relative to a member to be cleaned so that the brush opening faces to the member, said filter housing having air discharge openings formed in surfaces other than the surface in which the brush opening is formed;

a rotatable brush disposed in said filter housing at the brush opening for removing toner from the member to be cleaned; and a filter disposed along inner surfaces of said filter housing so as to cover the air discharge openings.

2. A cleaning apparatus according to claim 1, wherein:

said filter housing has an upper surface and a rear surface;

said air discharge openings being disposed in said upper and rear surfaces; and said filter being disposed along inner surfaces of said upper and rear surfaces.

3. A cleaning apparatus according to claim 1, wherein:

said filter housing has an bottom surface and a rear surface;

said air discharge openings being disposed in said bottom and rear surfaces; and said filter being disposed along inner surfaces of said bottom and rear surfaces.

4. A cleaning apparatus according to claim 1, wherein:

said filter housing has an upper surface, a lower surface, and a rear surface;

said air discharge openings being disposed in said upper, lower, and rear surfaces; and said filter being disposed along inner surfaces of said upper, lower, and rear surfaces.

5. A cleaning apparatus according to one of claims 1 to 4, wherein said member to be cleaned is a transfer drum which supports a recording medium on which at least one toner image formed on an electrophotographic photosensitive member is transferred.

6. An electrophotographic image forming apparatus for forming an image on a recording medium, comprising:

an electrophotographic photosensitive member;

toner image forming means for forming a toner image on said electrophotographic photosensitive member;

a rotatable transfer drum for supporting a recording medium onto which the toner image formed on said electrophotographic photosensitive member by said toner image forming means is transferred;

a filter housing having a brush opening formed in one surface thereof and being disposed relative to said transfer drum so that the brush opening faces to said transfer drum, said filter housing having air discharge openings formed in surfaces other than the surface in which the brush opening is formed;

a rotatable brush disposed in said filter housing at the opening for removing a toner from said transfer drum;

a filter disposed along inner surfaces of said filter housing so as to cover the air discharge openings; and convey means for conveying the recording medium.

7. A cleaning apparatus according to claim 6, wherein:

said filter housing has an upper surface and a rear surface;

said air discharge openings being disposed in said upper and rear surfaces; and said filter being disposed along inner surfaces of said upper and rear surfaces.

8. A cleaning apparatus according to claim 6, wherein:

said filter housing has an bottom surface and a rear surface;

said air discharge openings being disposed in said bottom and rear surfaces; and said filter being disposed along inner surfaces of said bottom and rear surfaces.

9. A cleaning apparatus according to claim 6, wherein:

said filter housing has an upper surface, a lower surface, and a rear surface;

said air discharge openings being disposed in said upper, lower, and rear surfaces; and said filter being disposed along inner surfaces of said upper, lower, and rear surfaces.

10. A toner cleaning apparatus comprising:

a filter housing having a brush opening formed in one surface thereof and being disposed relative to a member to be cleaned so that the brush opening faces to the member, said filter housing having air discharge openings formed in surfaces other than the surface on which the brush opening is formed;

a brush case connected to said filter housing along the surface in which the brush opening is formed;

a rotary brush rotationally disposed in said brush case and urged against the member to be cleaned for removing a toner from the member to be cleaned; and a filter disposed along inner surfaces of said filter housing so as to cover the air discharge openings.

11. A toner cleaning apparatus according to claim 10, wherein discharge ports are formed in said brush case in such a manner that, when said filter housing is connected to said brush case, said discharge ports are aligned with some of said discharge openings of said filter housing.

12. A toner cleaning apparatus according to claim 10 or 11, wherein said filter housing is divided into a plurality of pieces so that said filter housing can be disassembled and assembled.

13. A toner cleaning apparatus according to claim 12, wherein said filter is incorporated into said filter housing by closing said filter housing after said filter is mounted within said filter housing in contact with inner walls of said filter housing.

14. An image forming apparatus having at least an image bearing member, a developing means and a transfer means, said image forming apparatus comprising:

a filter housing having a brush opening formed in one surface and being disposed relative to a member to be cleaned so that the brush opening faces to the member, said filter housing having air discharge openings formed in surfaces other than the surface in which the brush opening is formed;

a brush case connected to the opened surface of said filter housing;

a rotary brush rotationally disposed in said brush case and urged against said member to be cleaned for removing a toner from the member to be cleaned; and a filter disposed along inner surfaces of said filter housing to cover the air discharge openings.

* * * * *

UNITED STATES PATENT AND TRADEMARK OFFICE

CERTIFICATE OF CORRECTION

PATENT NO. : 5,583,626 Page 1 of 3

DATED : December 10, 1996

INVENTOR(S) : TOMOO NAGAOKA

It is certified that error appears in the above-indentified patent and that said Letters Patent is hereby corrected as shown below:

COLUMN 1:

Line 10, "matters" should read --matter--.
Line 40, "4.." should read --4.--.

COLUMN 2:

Line 2, "an" should read --and--.
Line 13, "cam a" should read --cam, a--.

COLUMN 3:

Line 37, "in synchronous" should read --synchronously--.
Line 61, "was" should read --is--.

UNITED STATES PATENT AND TRADEMARK OFFICE

CERTIFICATE OF CORRECTION

PATENT NO. : 5,583,626

DATED : December 10, 1996

INVENTOR(S) : TOMOO NAGAOKA

It is certified that error appears in the above-indentified patent and that said Letters Patent is hereby corrected as shown below:

COLUMN 4:

Line 35, "30b" should read --30d--.
Line 38, "30b" should read --30d--.
Line 47, delete "the" (second occurrence).

COLUMN 5:

Line 50, "every after" should read --every time after--.
Line 64, "waster" should read --waste--.

COLUMN 6:

Line 13, "abuts" should read --abut--.
Line 31, "203" should read --20j--.
Line 33, delete "to the".

UNITED STATES PATENT AND TRADEMARK OFFICE

CERTIFICATE OF CORRECTION

PATENT NO. : 5,583,626 Page 3 of 3

DATED : December 10, 1996

INVENTOR(S) : TOMOO NAGAOKA

It is certified that error appears in the above-indentified patent and that said Letters Patent is hereby corrected as shown below:

COLUMN 7:

Line 26, "later." should read --latter--.

COLUMN 8:

Line 31, "one" should read --anyone--.
Line 17, "an" should read --a--.

Signed and Sealed this

Twentieth Day of May, 1997

Bruce Lehman

*Attest:*

BRUCE LEHMAN

*Attesting Officer*

*Commissioner of Patents and Trademarks*